US006000316A

United States Patent [19]

Møller et al.

[11] Patent Number: 6,000,316

[45] **Date of Patent: *Dec. 14, 1999**

[54] HYDRAULIC AXIAL PISTON MACHINE

[75] Inventors: Henry Madsen Møller; Lars Martensen, both of Sønderborg, Denmark

[73] Assignee: Danfoss A/S, Nordborg, Denmark

[ * ] Notice: This patent issued on a continued prosecution application filed under 37 CFR 1.53(d), and is subject to the twenty year patent term provisions of 35 U.S.C. 154(a)(2).

[21] Appl. No.: 08/765,410

[22] PCT Filed: Jun. 30, 1995

[86] PCT No.: PCT/DK95/00278

§ 371 Date: Dec. 26, 1996

§ 102(e) Date: Dec. 26, 1996

[87] PCT Pub. No.: WO96/02757

PCT Pub. Date: Feb. 1, 1996

[30] Foreign Application Priority Data

Jul. 13, 1994 [DE] Germany ..... 44 24 609

[51] Int. Cl.[6] ..... F01B 3/02

[52] U.S. Cl. ..... 92/57; 92/71

[58] Field of Search ..... 91/499; 92/12.2, 92/57, 71

[56] References Cited

U.S. PATENT DOCUMENTS

| | | | |
|---|---|---|---|
| 3,468,263 | 9/1969 | Niemiec | 91/499 |
| 3,636,820 | 1/1972 | Lambeth | 91/499 |
| 3,807,283 | 4/1974 | Alderson et al. | 91/499 |
| 3,978,772 | 9/1976 | Miyao et al. | 92/172 |
| 4,117,768 | 10/1978 | Affouard | 91/499 |
| 5,032,061 | 7/1991 | Porel | 92/12.2 |

FOREIGN PATENT DOCUMENTS

| | | | |
|---|---|---|---|
| 1314483 | 12/1962 | France | 92/12.2 |
| 444458 | 5/1927 | Germany | 91/499 |

*Primary Examiner*—F. Daniel Lopez

*Attorney, Agent, or Firm*—Lee, Mann, Smith, McWilliams, Sweeney & Ohlson

[57] ABSTRACT

A hydraulic axial piston machine (1) is disclosed, having a cylinder drum (3) with at least one cylinder (4), in which a piston (5) is arranged to move back and forth, which piston bears by way of a slider shoe (7) against a swash plate (8), wherein a pressure plate (9) is provided which holds the slider shoe (7) in contact with the swash plate (8) and is supported against the cylinder drum (3) by way of a ball-and-socket joint (10) comprising a ball-like body (12) and a counterpart (13). In such an arrangement, one would like to avoid weakening the pressure plate by the ball-and-socket joint. To that end, a part of the ball-and-socket joint (10) is provided with a supporting surface (17) which extends substantially parallel to the surface of the pressure plate (9) and by means of which this element (12) lies in face-to-face contact with the pressure plate (9).

13 Claims, 2 Drawing Sheets

Figure 3:
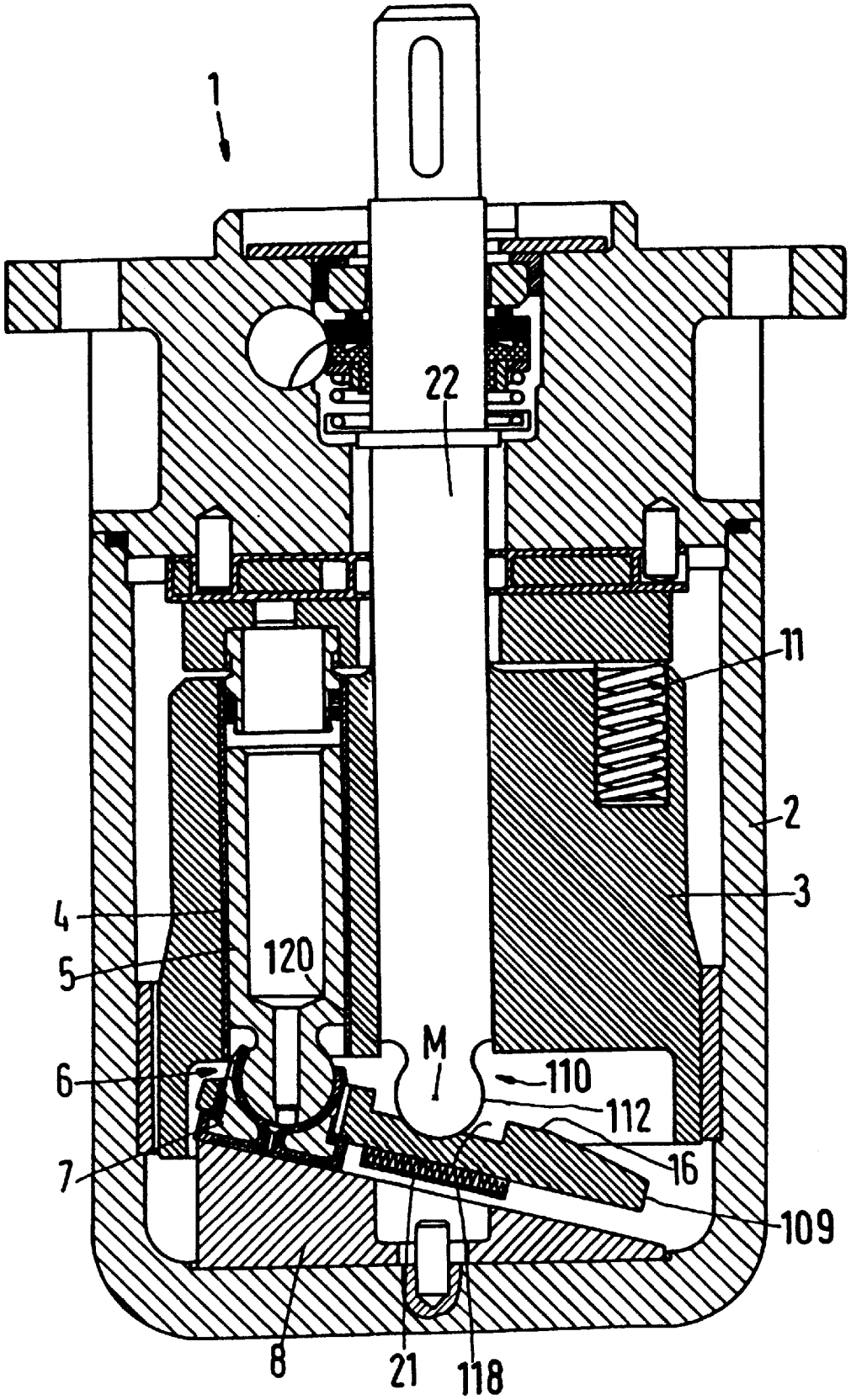

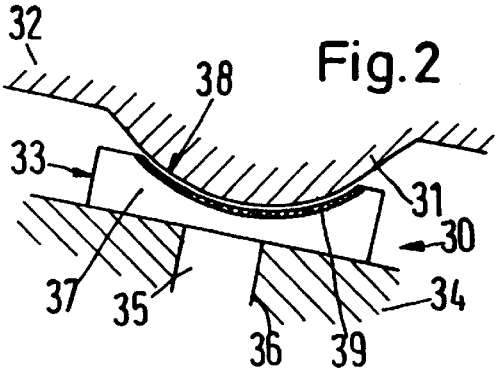
Fig.2
Fig.1
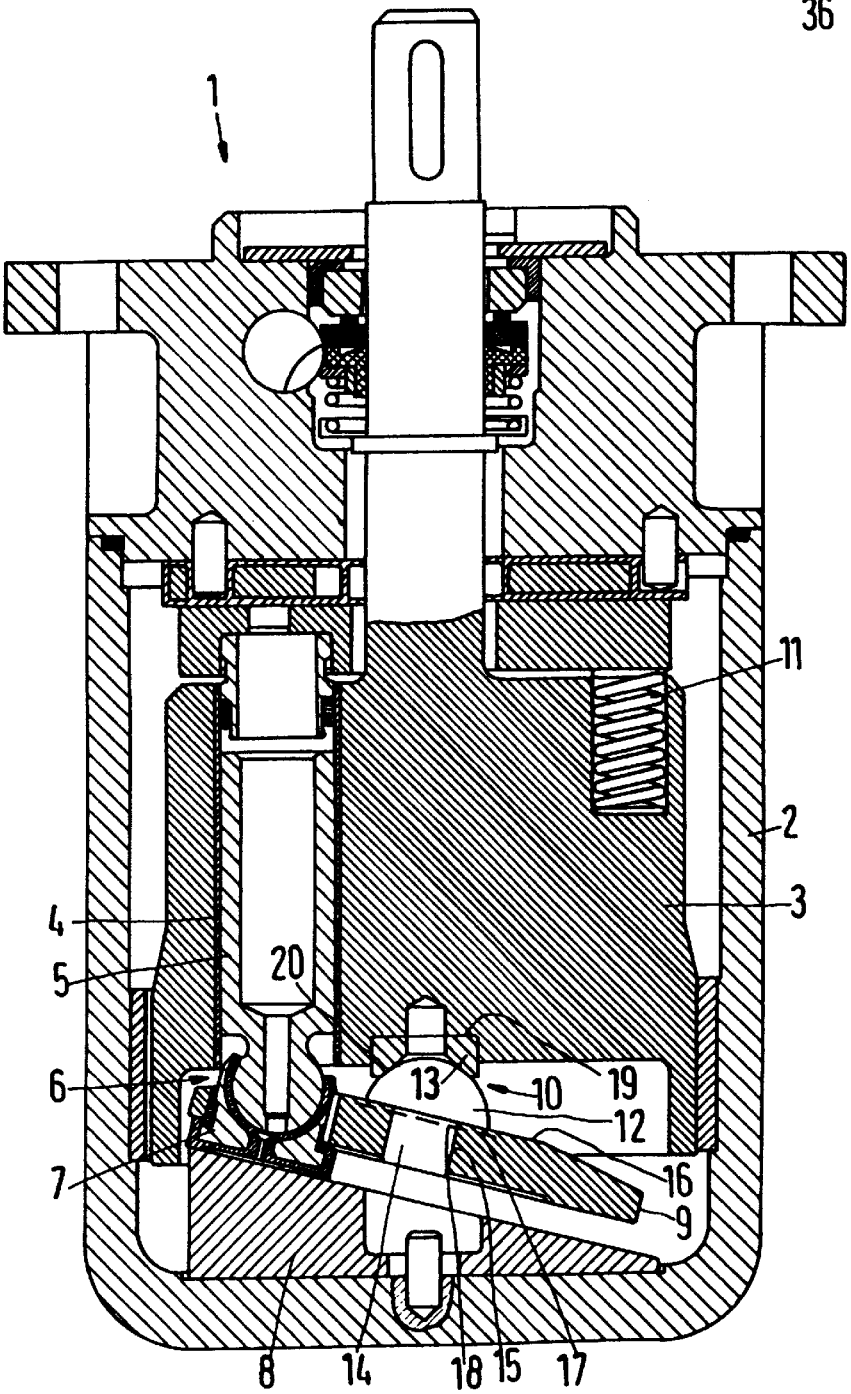

HYDRAULIC AXIAL PISTON MACHINE

The invention relates to a hydraulic axial piston machine having a cylinder drum with at least one cylinder, in which a piston is arranged to move back and forth, which piston bears by way of a slider shoe against a swash plate, wherein a pressure plate is provided which holds the slider shoe in contact with the swash plate and is supported against the cylinder drum by way of a ball-and-socket joint comprising a ball-like body and a counterpart.

In an axial piston machine of that kind, the pressure plate is guided without axles or shafts, that is to say, the shaft around which the cylinder drum rotates is not taken through the pressure plate. Such an arrangement is frequently used in the case of smaller axial piston machines, although the principle can be applied regardless of the size of the axial piston machine.

Since the pressure plate is intended to hold the slider shoes in contact with the swash plate, it must carry out a continuous tilting movement with respect to the cylinder body on rotary movement of the cylinder drum. To allow this tilting movement, U.S. Pat. No. 2,733,666 provides a ball-and-socket joint which is formed from a ball which is inserted on the one hand in a correspondingly spherical recess in the pressure plate and on the other hand lies in a correspondingly spherical recess in the end face of a piston which is displaceable in the cylinder drum and is supported with respect to the cylinder drum by a pressure spring.

Such an arrangement requires the pressure plate to be provided with a spherical recess, however, which leads to commensurate weakening of the pressure plate with the result that deformation of the pressure plate is to be feared should correspondingly larger forces be applied. This in turn results in the slider shoes no longer being held in face-to-face contact with the swash plate, but lifting slightly, so that the desired hydrostatic lubrication of the slider shoes is no longer guaranteed. In addition, the operational behaviour of the machine changes if the pistons do not completely travel the prescribed distance.

The invention is based on the problem of improving the operational behaviour of an axial piston machine.

In a hydraulic axial piston machine of the kind mentioned in the introduction, this problem is solved in that a pressure plate part of the ball-and-socket joint associated with the pressure plate has a supporting surface which extends substantially parallel to the surface of the pressure plate and by means of which the pressure plate part lies in face-to-face contact with the pressure plate.

This construction of the pressure plate part avoids weakening the pressure plate or keeps any weakening small. The forces acting by way of the pressure plate part on the pressure plate are primarily transmitted through the bearing area. Widening of the recess known from U.S. Pat. No. 2,733,666, for instance in a radial direction by forces acting like wedges, which the ball shown in that specification makes possible, can at least largely be avoided by the new construction. The changed force transmission now enables the slider shoes to be held against the swash plate with greater reliability.

Greater pressure forces can even be applied, which further improves the operational behaviour of the machine, for instance, when it is wished to use the machine as a pump. In that case higher suction pressures are possible.

The pressure plate preferably has a shaped configuration on its upper side with a bounding wall oriented substantially radially. This configuration enables forces also acting in a radial direction to be transmitted to the pressure plate. These forces are not, however, converted by forces resulting from the effect of a slope into axial forces, such as are to be observed, for example, in the case of a spherical recess. On the contrary, a relatively good separation of axial and radial forces acting on the pressure plate is achieved by this construction. In the case of the radially acting forces, the pressure plate now has virtually its entire radius available as abutment, so that no deformation worth mentioning need be feared.

The shaped configuration is preferably in the form of a bore into which a bolt-like extension of the pressure plate part projects. The bolt-like extension therefore secures the position of the pressure plate part on the pressure plate against displacement in radial directions. The bolt-like extension is able to transfer radially acting forces to the pressure plate. The bore can be, but does not have to be, in the form of a through-bore. The bolt-like extension has at any rate a smaller diameter than the supporting surface so that although the pressure plate is slightly weakened by the bore, this weakening can be kept to such a low level by selecting a correspondingly small diameter of the bore that it has no noticeable impact. In particular, however, no wedge faces are produced, by which forces are transferred to the pressure plate in such a manner that an undesirable deformation occurs.

In an alternative or additional construction, the shaped configuration can be in the form of a depression, the border of which acts on the border of the pressure plate part. This too produces a definite interlocking engagement, by which the position of the pressure plate part on the pressure plate is fixed. Here too, the effective forces are able to lead to deformation of the pressure plate only under unfavourable circumstances.

In a hydraulic axial piston machine of the kind mentioned in the introduction, the problem is also solved by the pressure plate part being constructed in one piece with the pressure plate and projecting from this in the direction of the cylinder drum. This construction also avoids weakening the pressure plate. At the same time, however, the mounting area required by the ball-and-socket joint is freed. In this one-piece construction, the supporting surface extends virtually inside the pressure plate.

The counterpart is preferably in the form of a plastics material ring which is supported axially and is radially enclosed at least for a predetermined part of its height by the supporting part. The supporting part, depending on the arrangement, is the cylinder drum or the pressure plate. Because the plastics material ring is supported in this manner, namely, axially and radially, it is possible to use a material which itself does not have the requisite strength to be able to absorb the necessary pressure forces without becoming deformed. The pressure forces are transferred instead to the supporting part, so that the desired geometry is still at least largely maintained.

The ring preferably has a conical sliding-contact surface. A conical sliding-contact surface is easier to manufacture than a spherical sliding-contact surface. Reliable engagement of the ball-like body on the counterpart can nonetheless be realized with this conical sliding-contact surface.

The ball member preferably lies adjacent to the counterpart in the region of the axial limit of the radial support. Contact between a spherical or ball-like surface and a conical sliding-contact surface is normally in the form of a line. Because plastics material has been used for the counterpart, there will, however, be a certain amount of deformation, so that contact extends over a somewhat wider strip. If contact is effected in the region of the axial limit of the radial support of the counterpart, the counterpart is allowed to deform beyond this region, so that as a result an enlarged contact area between the ball member and the counterpart becomes possible. A pressure-contact area enlarged in this manner reduces the surface pressure and thus the wear and tear, with the result that the service life is extended.

In a hydraulic axial piston machine of the kind mentioned in the introduction, in which the pressure plate has a recess in the region of the ball-and-socket joint to receive a part of the ball-and-socket joint, the problem is also solved in that the pressure plate has a reinforcement on its side remote from the ball-and-socket joint. Although the pressure plate would be weakened by the recess, which in some cases is necessary to receive the ball-and-socket joint or a part thereof, this weakening can be eliminated by providing a corresponding reinforcement on the other side of the pressure plate. On that side of the pressure plate there is in fact sufficient space available. This space is formed by the area between the pressure plate and the swash plate. These two parts are spaced from one another by a distance which is formed by the thickness of that part of the slider shoes which lies adjacent to the swash plate. Accordingly, the space available for the reinforcement is, moreover, limited radially only by the slider shoes. Care should be taken here that the reinforcement does not touch the slider shoes. If the reinforcement is of an appropriately large dimension, a wedging action can even be allowed again, that is to say, the ball-and-socket joint can be allowed to have a spherically concave bearing surface in the pressure plate. Deformation is reliably prevented by the reinforcement.

It is here especially preferred for the reinforcement to have a thickness which approximately corresponds to or is larger than the depth of the recess. The weakening originally caused by the recess is thus virtually completely eliminated again.

In all cases it is preferred for the midpoint of the ball on which the surface of the ball-like member lies, to lie within the pressure plate or in the plane of its surface. When the pressure plate pivots in operation, as the cylinder drum is rotating, the displacements of the pressure plate which are produced with respect to the slider shoes are extremely small.

In another construction, the counterpart is preferably formed on the head of a bolt which extends into the pressure plate. In that case, the ball member is arranged on the cylinder drum. The head of the bolt then lies in face-to-face contact with the pressure plate. The ball-and-socket joint can also be formed in this manner without weakening the pressure plate.

In a preferred construction, provision is made for the ball-like body to lie adjacent to a sliding-contact surface of the counterpart, which surface is formed from a plastics material, which co-operates with the material of the surface of the ball-like body to provide low friction. The plastics material is preferably selected from the group of high-strength thermoplastic plastics materials based on polyarylether ketones, in particular polyether ether ketones, polyamides, polyacetals, polyaryl ethers, polyethylene terephthalates, polyphenylene sulphides, polysulphones, polyether sulphones, polyether imides, polyamideimide, polyacrylates, phenol resins, such as novolak resins. Such plastics materials are able to co-operate with metals to provide relatively low friction even when there is no lubrication by oil. The plastics material preferably includes a filler selected from glass, graphite, polytetrafluoroethylene or carbon, in particular in fibre form. The strength of the bearing element can be further increased by such a fibre filling. In such a construction it is possible to use even water, for example, as the hydraulic fluid. The lubrication that is lacking when water is used is then effected by the friction-reducing plastics material.

The ball-and-socket joint is preferably supported directly at the cylinder drum and the cylinder drum is subjected to a pressure force. The provision between them of a pressure piston, which in its turn would have to be provided with springs or similar means, is therefore dispensed with. The cylinder drum can therefore be made correspondingly smaller. Moreover, weakening of the cylinder drum by the relatively large bore for such a piston is avoided.

To generate the pressure force, an odd number of pressure springs is preferably provided at the end of the cylinder drum remote from the pressure plate, and the springs are arranged between the cylinders. The force on the pressure plate is thus transmitted directly by way of the cylinder drum. The use of an odd number of pressure springs reduces the danger of tilting. The pressure force is rendered more uniform.

A cylinder drum part associated with the cylinder drum is preferably in the form of an end of a shaft defining the rotary axis of the cylinder drum. A one-piece construction of the cylinder drum part and the part carrying this part of the ball-and-socket joint can therefore be achieved. The shaft is generally more simple to machine than the cylinder drum itself, which is attributable, for example, to the smaller size of the shaft. Moreover, the cylinder drum part can now be made of a different, if desired stronger, material from that of the cylinder drum, which further increases the load capacity of the machine.

The shaft is advantageously fixedly connected, at least in the axial direction, to the cylinder drum. It can be connected to the cylinder drum in the radial direction as well, so that the connection between the shaft and the cylinder drum, can be effected, for example, by soldering or welding. In this manner, the necessary pressure forces can be transferred to the pressure plate by way of the cylinder drum.

The invention is described hereinafter with reference to preferred embodiments in conjunction with the drawing, in which FIG. 1 is a diagrammatic cross-section through an axial piston machine, FIG. 2 shows an alternative construction of a ball-and-socket joint, and FIG. 3 shows a further construction of an axial piston machine.

A hydraulic axial piston machine 1 has a cylinder drum 3 rotatably mounted in a housing 2. In the cylinder drum 3 there are arranged several cylinders 4, only one of which is illustrated. In each cylinder 4 a piston 5 is arranged to move back and forth. The piston 5 is articulated by means of a ball-and-socket joint 6 with a slider shoe 7. The slider shoe 7 is supported on a swash plate 8. In order to keep the slider shoe 7 in position on the swash plate 8, a pressure plate 9 is provided, which bears by way of a ball-and-socket joint 10 on the cylinder drum 3. The cylinder drum 3 is pressed by an odd number of pressure springs 11 towards the swash plate 8. The pressure springs 11 are here distributed in the circumferential direction between individual cylinders 4.

In the construction according to FIG. 1, the ball-and-socket joint comprises a ball-like body 12 and a counterpart 13. The term "ball-like body" merely indicates that the ball-like body 12 has a spherical surface, that is, a part of a surface of a sphere. The ball-like body 12 itself is not constructed in the form of a complete ball, as is the case, for example, in a known arrangement according to U.S. Pat. No. 2,733,666.

The ball-like body 12 has a bolt-like extension 14 which passes through a bore 15 in the pressure plate. The bore 15 and the extension 14 are illustrated with an exaggeratedly large diameter for the sake of clarity. They can, of course, also be constructed with a relatively small diameter. It is important merely that the bore 15 has walls which extend substantially at right angles to the upper side 16 of the pressure plate 9, so that these walls of the bore 15 are able to accommodate forces directed radially onto the pressure plate 9, and substantially only these forces.

Surrounding the extension 14 the ball-like body 12 has a supporting surface 17 which is substantially flat and extends substantially parallel to the top side 16 of the pressure plate 9. The ball-like body 12 lies with this supporting surface 17 in face-to-face contact with the contact plate 16. By means of this face-to-face bearing contact, forces which are directed substantially axially onto the pressure plate, that is, at right angles to the top side 16, can be transferred to the pressure plate 9. The forces acting on the pressure plate 9 in the two principal directions, namely, radially and axially, can thus be separated. Regardless of the direction of forces which act by way of the ball-like body 12 on the pressure plate 9, there is therefore no need to fear displacement of the ball-like body 12 or a deformation caused thereby of the pressure plate 9.

A depression 18 on the top side 16 of the pressure plate is illustrated by a broken line. The ball-like body 12 can be inserted in this depression 18, the border of the depression 18 acting on the border of the ball-like body 12. This construction likewise absorbs radial forces which act between the ball-like body 12 and the pressure plate 9. This measure can be used in addition to the extension 14 or in place of the extension 14. In the depression 18 the ball-like member 12 lies likewise in face-to-face contact with the pressure plate 9.

The counterpart 13 is formed by a plastics material ring which is arranged in a recess 19 in the cylinder drum 3. The recess 19 supports the counterpart 13 axially, that is, the counterpart 13 lies in face-to-face contact with the cylinder drum 3. Moreover, the recess 19 supports the counterpart 13 radially with its circumferential wall. This support is restricted, however, to a predetermined axial length of the counterpart 13. In other words, the counterpart 13 projects from the cylinder drum 3 for part of its axial length.

The counterpart 13 has a conical bearing surface 20 which co-operates with the ball-like body 12. Normally, the contact zone between a ball and a cone is formed by a line. The counterpart 13, however, is formed from a plastics material which co-operates with the material of the ball-like body 12 to provide low friction. This material is softer than that of the ball-like body 12, which can be, for example, steel, so that the counterpart 13 is deformed to a certain extent. This deformation is also rendered possible when contact between the ball-like body 12 and the counterpart 13, viewed in the axial direction, takes place beyond the cylinder drum 3, or viewed in the axial direction, approximately at the point where radial support of the counterpart 13 ceases. The outer tips of the counterpart 13 are therefore able to bend outwards somewhat, so that the bearing surface, that is, the area with which the ball-like body 12 lies against the counterpart 13, is increased. This improves the bearing properties.

In the present construction, the ball-and-socket joint 10 is arranged immediately between the cylinder drum 3 and the pressure plate 9, that is, no moving parts are provided between the ball-and-socket joint 10 and the cylinder drum 2.

FIG. 2 shows a different construction of a ball-and-socket joint 30. Here, the ball-like body 31 is arranged on the cylinder drum 32, whilst the counterpart 33 is associated with the pressure plate 34. The ball-like body 31 can in this case also be constructed in one piece with the cylinder drum 32. As clear from FIG. 2, the ball-like body is not a complete ball, but merely a projection of the cylinder drum 32 with a spherically convex surface.

The counterpart 33 is in the form of the head 37 of a bolt 35 which passes through the bore 36 in the pressure plate 34. On the side of the head 37 remote from the pressure plate 34 a spherically concave recess 38 is provided, in which the ball-like body 31 lies. This recess 38 is provided with a coating 39 of a plastics material which co-operates with the material of the ball-like body 31 to provide low friction.

Here too, the head 37 of the bolt 35 lies in face-to-face contact with the pressure plate 34. The bolt 35 safeguards against radial displacement of the head 37 on the pressure plate 34.

FIG. 3 shows a further construction of an axial piston machine, in which identical parts are provided with identical reference numbers and corresponding parts are provided with reference numbers increased by 100.

Unlike the construction according to FIG. 1, the pressure plate 109 in this construction is constructed with a very noticeable depression 118 into which the ball-like body 112 of the ball-and-socket joint 110 projects. This construction is selected so that the midpoint M of the ball forming the bearing surface lies within the pressure plate 109, or rather in the plane of the surface 16. The ball-like body 112 lies by way of the bearing surface 120, which is formed from a friction-reducing plastics material, against the pressure plate 109.

Weakening of the pressure plate 109 caused by the recess 118 is counteracted by a reinforcement 21 which is arranged on the side of the pressure plate 109 remote from the ball-and-socket joint 110. This reinforcement 21 has a thickness that corresponds approximately to or is larger than the depth of the recess 118. The reinforcement 21 has a diameter which corresponds approximately to the diameter of the recess 118. The reinforcement 21 can also be larger. It can be formed by an additional part which is mounted on the underside of the pressure plate 109 and is there connected to the pressure plate 109, for example, by soldering or welding. The reinforcement 21 can, of course, also be formed in one piece with the pressure plate 109. In principle, the entire space between the swash plate 8 and the pressure plate 109 is available for the reinforcement. In the radial direction the extent of the recess is limited only by the slider shoes 7.

Furthermore, compared with the construction according to FIG. 1, the cylinder drum is not constructed in one piece with the shaft. On the contrary, a separate shaft 22 is now provided, the end of which nearest the pressure plate 109 is in the form of a ball-like head 112. The shaft 22 is soldered or welded or fixedly secured in some other manner to the cylinder drum 3, this fixed connection being effective at least in the axial direction. The forces which are transferred by the pressure springs 11 to the cylinder drum 3 can thus act on the shaft 22 and thus on the ball-like head 112. The latter can then transmit them to the pressure plate 109, with the result that the slider shoes 7 are held in engagement with the swash plate 8.

Machining of the shaft 22 is very much simpler than machining of the cylinder drum 3. Moreover, for the shaft 22, and thus also for the ball-like head 112, a different material from that for the cylinder drum 3 can be selected, whereby the strength of the ball-like head 112 and thus the forces which can be transmitted by way of the ball-and-socket joint 110 are increased, without having to forego the advantage of constructing the ball-like head 112 as if it were in one piece with the cylinder drum 3.

We claim:

1. A hydraulic axial piston machine having a rotatable cylinder drum with at least one cylinder in which a piston is arranged to move back and forth, the piston bearing by means of a slider shoe against a swash plate, and including a pressure plate formed to hold the slider shoe in contact with the swash plate, the pressure plate being supported against the cylinder drum by a ball-and-socket joint comprising a ball-like body and a counterpart having a portion engaging the ball-like body, a pressure plate part of the ball-and-socket joint associated with the pressure plate having a supporting surface which extends substantially parallel to an upper surface of the pressure plate, the pressure plate part being in contact with the pressure plate, and the counterpart comprising a plastics part which has the portion engaging the ball-like body directly supported axially and radially within the cylinder drum, and which is enclosed for at least a part of its height in the cylinder drum.

2. A machine according to claim 1, in which the counterpart has a conical sliding-contact surface.

3. A machine according to claim 1, in which the ball-like body is located adjacent to the counterpart in a region of axial extent of radial support of the counterpart.

4. A machine according to claim 1, in which the pressure plate includes a recess of predetermined depth proximate the ball-and-socket joint to receive a part of the ball-and-socket joint, the pressure plate part being located in the recess.

5. A machine according to claim 1, in which a midpoint of a ball of the ball-like body is located within the pressure plate.

6. A machine according to claim 1, in which the ball-like body is located in a sliding-contact surface on the counterpart, the sliding contact surface being formed from said plastics material which co-operates with the material of the ball-like body to provide low friction.

7. A machine according to claim 1, including an odd number of pressure springs located at an end of the cylinder drum remote from the pressure plate, the springs being located between the cylinders.

8. A machine according to claim 1, including an end of a shaft of the cylinder drum defining a rotary axis of the cylinder drum.

9. A machine according to claim 8, in which the shaft is fixed to the cylinder drum.

10. A machine according to claim 1, including a bore into which a bolt-like extension of the pressure plate part projects.

11. A machine according to claim 1, including a depression having a border which acts on a border of the pressure plate part.

12. A hydraulic axial piston machine having a rotatable cylinder drum with at least one cylinder in which a piston is arranged to move back and forth, the piston bearing by means of a slider shoe against a swash plate, and including a pressure plate formed to hold the slider shoe in contact with the swash plate, the pressure plate being supported against the cylinder drum by a ball-and-socket joint comprising a ball-like body and a counterpart, a pressure plate part of the ball-and-socket joint associated with the pressure plate having a supporting surface which extends substantially parallel to an upper surface of the pressure plate, the pressure plate part being in contact with the pressure plate, and the counterpart comprising a plastics part which is directly supported axially and which is enclosed for a least a part of its height by the cylinder drum.

13. A hydraulic axial piston machine having a rotatable cylinder drum with at least one cylinder in which a piston is arranged to move back and forth, the piston bearing by means of a slider shoe against a swash plate, and including a pressure plate formed to hold the slider shoe in contact with the swash plate, the pressure plate being supported against the cylinder drum by a ball-and-socket joint comprising a ball-like body and a counterpart having a portion engaging the ball-like body, a pressure plate part of the ball-and-socket joint associated with the pressure plate having a supporting surface which extends substantially parallel to an upper surface of the pressure plate, the pressure plate part being in contact with the pressure plate and having a bolt-like extension projecting into a bore in the pressure plate, and the counterpart comprising a plastics part which has the portion engaging the ball-like body supported axially and radially in the cylinder drum, and which is enclosed for at least a part of its height in the cylinder drum, the ball-like body including a ball having a midpoint located within the pressure plate.

* * * * *